US005234314A

United States Patent [19]

Ganz

[11] Patent Number: 5,234,314

[45] Date of Patent: Aug. 10, 1993

[54] ROTARY HOPPER TRANSFER MECHANISM

[75] Inventor: Robert H. Ganz, Saddle River, N.J.

[73] Assignee: Riverwood International Corporation, Atlanta, Ga.

[21] Appl. No.: 822,867

[22] Filed: Jan. 21, 1992

[51] Int. Cl.[5] ..... B65G 59/04

[52] U.S. Cl. ..... 414/797.8; 414/798.9; 414/917; 414/797

[58] Field of Search ..... 414/797, 798.9, 917, 414/737, 797.8

[56] References Cited

U.S. PATENT DOCUMENTS

| | | | |
|---|---|---|---|
| 2,954,881 | 10/1960 | Hopton et al. | 414/798.9 |
| 3,451,563 | 6/1969 | Luginbuhl | 414/798.9 |
| 4,065,001 | 12/1977 | Ohnako | 414/917 |
| 4,081,945 | 4/1978 | Calvert et al. | 414/797.8 |
| 4,441,852 | 4/1984 | Dixon | 414/917 |
| 4,518,301 | 5/1985 | Greenwell | 414/797.8 |
| 5,049,029 | 9/1991 | Mitsui et al. | 414/917 |
| 5,052,672 | 10/1991 | Horii | 414/917 |
| 5,057,066 | 10/1991 | Nagahashi et al. | 414/798.9 |
| 5,118,249 | 6/1992 | Romagnoli | 414/798.9 |
| 5,151,008 | 9/1992 | Ishida et al. | 414/917 |

FOREIGN PATENT DOCUMENTS 0581056 11/1977 U.S.S.R. ..... 414/917

*Primary Examiner*—Michael S. Huppert
*Assistant Examiner*—Gregory A. Morse
*Attorney, Agent, or Firm*—Charles E. Brown

[57] ABSTRACT

This relates to a transfer mechanism for transferring cartons from a magazine for such cartons. The mechanism includes first and second plates which are joined together for rotation in unison about a fixed shaft. The second plate has pivotally connected thereto a generally radially extending member to which there are connected parallel links which, in turn, are pivotally connected to a carrier in the form of a link parallel to the member and the carrier in turn carries a pair of suction type pickup heads. One of the parallel links extends beyond the other from the carrier and carries a cam follower which is engaged with a cam that is fixedly connected to the first plate for rotation therewith. The fixed shaft also carries a fixed gear which is meshed with a gear which is rotatably mounted on the first plate and which carries an eccentric pin engaged in a slot in the radially extending member to rock the same about its pivot.

15 Claims, 2 Drawing Sheets

ROTARY HOPPER TRANSFER MECHANISM

This invention relates in general to new and useful improvements in a transfer mechanism for transferring elements from a suitable holder, and more particularly for transferring cartons from a magazine for such cartons.

BACKGROUND OF THE INVENTION

In the forming of packages of containers such as cans, it is known to position carton blanks within a magazine overlying the path of containers utilizing a transfer mechanism for taking the lowermost carton from the magazine and applying it to the containers. Such carton may either be directly applied to containers or, more particularly, may be directed to a conveyor with the carton being in the form of a sleeve which is formed with cans from opposite ends thereof. On the other hand, the carton may be of the wrap around type wherein the carton is applied directly to the top of a group of containers after which the carton is folded down around and below the containers to form the package. In such event, the containers may be selected in the form of cans or bottles. Various types of transfer mechanisms may be provided.

One of the problems relating to the transfer of cartons from a magazine to a position for cooperation with a group of containers is the removal of the carton from the magazine. It has been found highly desirable to move a pickup head from a position immediately adjacent a lowermost carton towards the carton to engage the carton and then away from the magazine to remove the carton from the magazine.

BROAD DESCRIPTION OF INVENTION

In accordance with this invention, there has been provided a rotary hopper which is caused to rotate at a speed wherein cartons are applied to a container package forming machine at the same rate as the movement of the carton during the package forming operation. Most particularly, the transfer mechanism or rotary hopper has a pickup head which is mounted for rotation about a fixed axis and which pickup head, as it moves past an associated magazine is projected towards the lowermost carton of such magazine and then withdrawn after it engages the lowermost carton.

Most particularly, in accordance with this invention, the pickup head is carried by a linkage which is pivotally carried by a radially projecting member mounted for rotation and wherein the radially projecting member is mounted for pivotal movement with the pivotal movement of the member causing movement of the linkage relative to a cam so as to pivot the linkage relative to the member to effect the projection and retraction of the pickup head.

With the above and other objects in view that will hereinafter appear, the nature of the invention will be more clearly understood by reference to the following detailed description, the appended claims, and the several views illustrated in the accompanying drawings.

SHORT DESCRIPTION OF INVENTION

Figure 1:
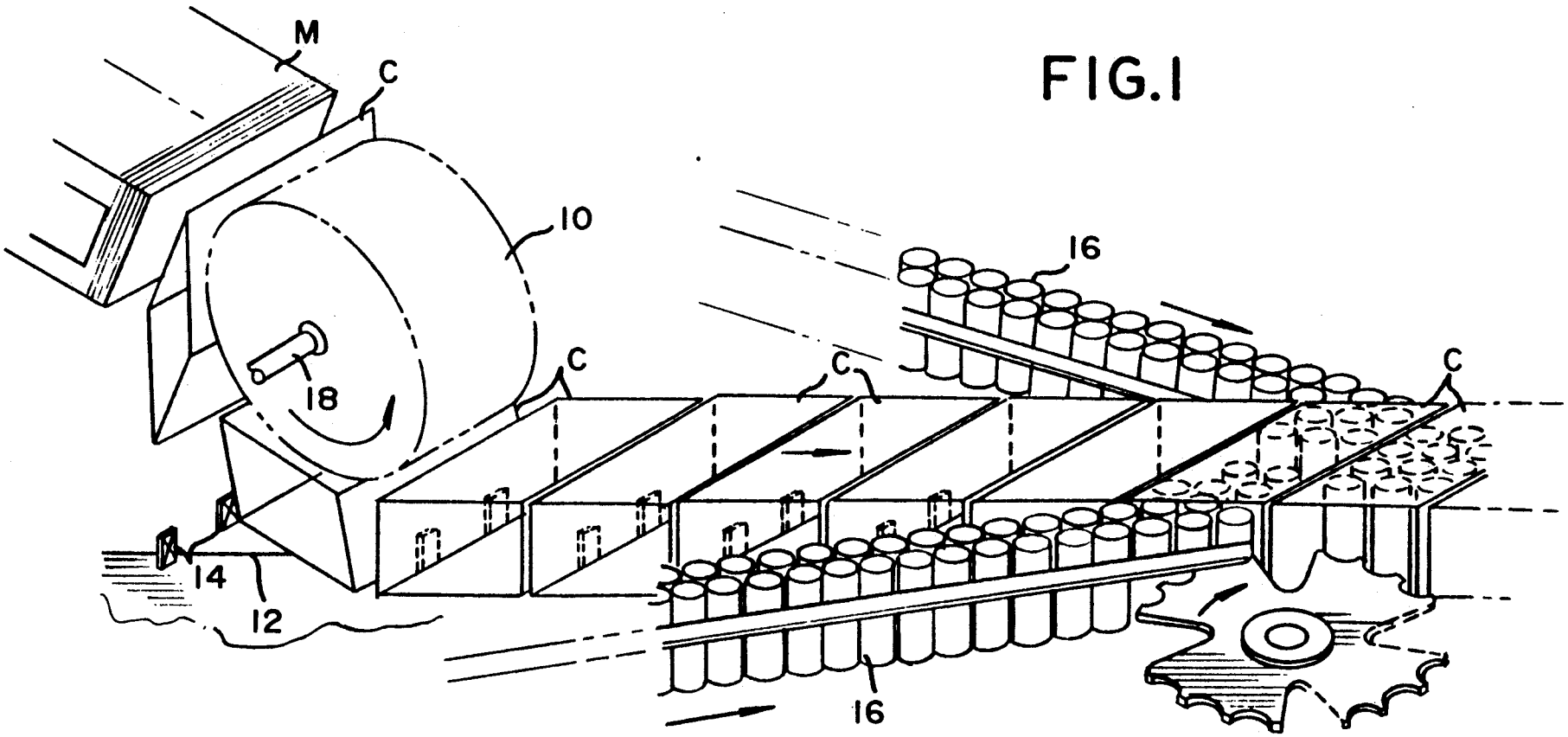
FIG. 1 is a schematic perspective view of a rotary hopper transfer mechanism formed in accordance with this invention showing the utilization thereof for transferring sleeve type cartons from a magazine to a carton conveying position in which the carton may be filled from its opposite ends with cans.

Reference is first made to FIG. 1 wherein there is illustrated broadly a rotary hopper transfer mechanism generally identified by the numeral 10 which may be constructed in accordance with this invention and shows the manner in which it is utilized in transferring cartons C from a magazine M to a container receiving position. It is to be noted that the illustrated cartons C are in the form of elongated sleeves having open opposite ends.

The cartons C, as they are drawn from the magazine M, are caused to be opened and are, in turn, seated on an advancing conveyor 12 having upstanding pusher members 14.

It will be seen that the open cartons C are moved along a straight line path by the conveyor 12 and that containers, in the form of cans 16, are progressively moved towards the open ends of the cartons C and then are forced into the cartons C to fill the cartons as is best illustrated at the right of FIG. 1.

As stated above, this invention has to do with the construction of a rotary hopper transfer mechanism 10.

Figure 2:
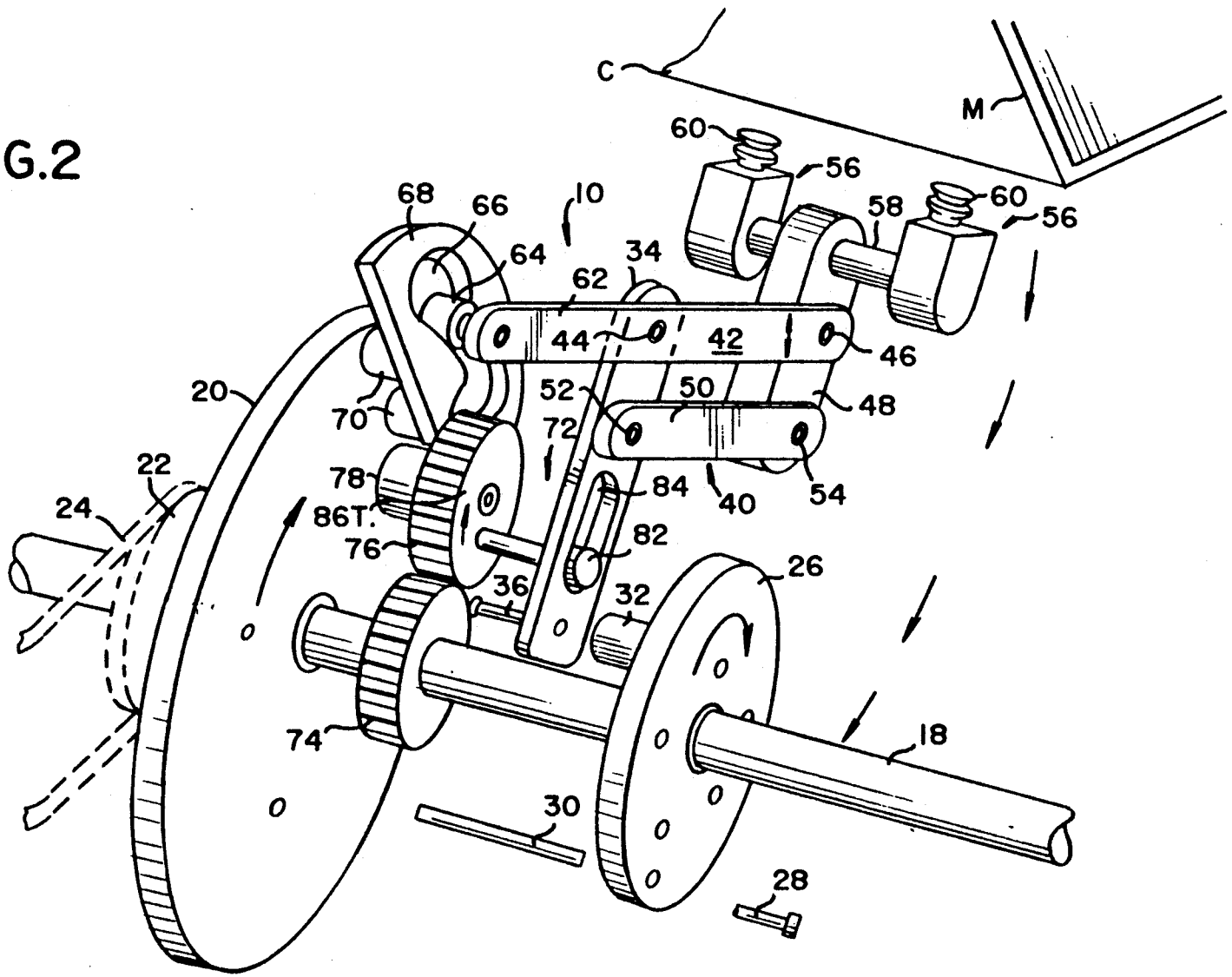
FIG. 2 is an exploded perspective view showing the specific details of the rotary hopper transfer mechanism.

Referring now to FIG. 2, it will be seen that there is illustrated the details of the transfer mechanism 10. The transfer mechanism 10 includes a fixed shaft 18, the position of which is illustrated in FIG. 1. The fixed shaft 18 has mounted thereon for rotation a first plate 20. The plate 20 is in the form of a circular wheel-like member. A drive pulley 22 is fixedly secured to the left face of the plate 20 for effecting rotation thereof. The drive pulley 22 is driven by means of a belt 24 from a drive unit (not shown).

The transfer mechanism 10 also includes a second plate 26 which is rotatably journalled on the fixed shaft 18. The plate 26 may be of a lesser diameter than the plate 20 and is fixedly secured to the plate 20 for rotation therewith by way of a plurality of fasteners 28 which extend through sleeves 30 that axially space the plates 20, 26.

The second plate 26 carries a boss 32 which projects towards the first plate 20. An elongated member 34 in the form of a link-like member is pivotally mounted on the boss 32 by way of a pivot pin 36 which extends through a lower bore 38 in the member 34. The member 34 extends radially outwardly from the boss 32.

The outer portion of the member 34 carries support linkage generally identified by the numeral 40. The support linkage 40 includes a first link 42 which is pivotally connected to an outer portion of the member 34 by a pivot pin 44. The right end of the link 42 is pivotally connected by a pivot pin 46 to a radially outwardly projecting carrier 48 which also forms part of the linkage means 40.

The linkage means 40 further includes a second link 50 which is pivotally connected to a radially inner part of the member 38 by way of a pivot pin 52 and to a radially inner part of the carrier 48 by a pivot pin 54. The links 42, 50 are arranged parallel to one another and thus the linkage means 40 in the preferred embodiment of the invention is in the form of a parallel linkage.

The outer end of the carrier 48 carries at least one pickup head 56. In the illustrated embodiment of the invention, there are two pickup heads 56 mounted on opposite ends of a transverse support shaft 58 which is disposed parallel to the fixed shaft 18. The pickup heads 56 may be of any desired construction with each pickup head 56 being illustrated as having a suction cup 60 for engaging a carton C. If desired, suitable vacuum and pressure lines may be connected to the pickup heads 56 to facilitate the engagement of a carton C and the forcible discharge thereof.

In accordance with this invention, the parallel linkage 40 is pivoted in a manner so as to first move the carrier 48 radially outwardly to a position where the pickup heads 56 engage a carton, and then radially inwardly to retract such carton from the associated magazine M.

In order to effect the pivoting of the parallel linkage 40 relative to the member 34, the first link 42 is provided with an extension 62 which extends to the left of the member 34 in FIG. 2. The extension 62 is provided with a cam follower 64 which is engaged within a cam track 66 formed in a cam 68 carried by the first plate 20 for rotation therewith. The cam 68 is mounted in spaced relation to the right face of the first plate 20 towards the second plate 26 by means of a pair of spacers 70.

In order that the cam follower 64 and the cam 68 may function to effect the pivoting of the parallel linkage 40 relative to the member 34, it is necessary to rock the member 34 circumferentially about the pivot pin 36. This is effected by an eccentric drive means generally identified by the numeral 72. The drive means 72 includes a fixed gear 74 fixedly mounted on the fixed shaft 18 between the plates 20, 26. The drive means 72 also includes a rotating gear 76 which is mounted in spaced relation from the right face of the first plate 20 by way of a boss 78. It will be seen that as the plate 20 and the gear 76 rotate about the fixed shaft 18, the gear 76 rides about the fixed gear 74 so as to effect rotation of the gear 76.

The gear 76 carries an eccentric drive in the form of a drive pin projecting from the right face of the gear 76 in eccentric relation with respect to the axis of rotation of the gear 76. The drive pin 80 is provided with an enlarged head which is seated in a radially extending slot 84 formed in a lower portion of the member 34. It will be obvious that as the gear 76 rotates, the drive pin 80 will effect rocking of the member 34 about the pivot pin 36. The rocking action of the member 34 effects a rocking action of the pickup heads 56 together with a radial advance and retraction of the pickup heads 56 so as to properly engage a lowermost carton C in the magazine M and draw the same from the magazine.

Although the transfer mechanism 10 has been illustrated with the gears 74, 76 of equal size so that the gear 76 effects one rotation each time the plates 20, 26 rotate about the fixed shaft 18, and only one pickup arrangement has been illustrated, it is to be understood that multiple pickup units may be carried by the plates 20, 26.

Although only a preferred embodiment of the transfer mechanism has been specifically illustrated and described herein, it is to be understood that minor variations may be made in the transfer mechanism without departing from the spirit and scope of the invention as defined by the appended claims.

I claim:

1. A transfer mechanism for transferring cartons from a magazine to a place of use, said transfer mechanism comprising a shaft fixed against rotation, first and second plates mounted on said shaft for rotation in unison relative to said fixed shaft, a radially outwardly projecting member pivotally mounted on said second plate for rotation with said second plate and pivotal movement relative to said second plate, parallel linkage carried by said member and including first and second links pivotally connected to said member, said parallel linkage also including a carrier pivotally connected to both said first link and said second link, a pickup unit carried by said carrier, said first link having an extension extending beyond said member in the direction away from said pickup unit and carrying a cam follower engaged with a cam fixedly secured to said first plate for rotation with said first plate, the relationship of said member, said parallel linkage and said cam forming means for radially projecting and retracting said pickup head in response to pivoting of said member relative to said second plate, and cooperating means carried by said first plate and said shaft for pivoting said member as said plates rotate relative to said shaft.

2. A transfer mechanism according to claim 1 wherein said cooperating means includes an eccentric connected to said member.

3. A transfer mechanism according to claim 1 wherein said cooperating means includes an eccentric carried by said first plate and connected to said member.

4. A transfer mechanism according to claim 1 wherein said cooperating means includes a fixed drive element carried by said shaft, a driven element carried by said first plate and rotatable relative to said first plate coupled to said drive element for rotation in response to rotation of said first plate.

5. A transfer mechanism according to claim 4 wherein said cooperating means includes an eccentric connected between said driven element and said member for effecting pivoting of said member.

6. A transfer mechanism according to claim 5 wherein said eccentric is in the form of a pin projecting axially from said driven element and engaged in a radially extending slot in said member.

7. A transfer mechanism according to claim 4 wherein said drive element and said driven element are in the form of meshing gears.

8. A transfer mechanism for transferring cartons from a magazine to a place of use, said transfer mechanism comprising a shaft fixed against rotation, first and second plates mounted on said shaft for rotation in unison relative to said fixed shaft, a radially outwardly projecting member pivotally mounted on said second plate for rotation with said second plate and pivotal movement relative to said second plate, a carrier carrying a pickup head, linkage means connecting said carrier to said member, said linkage means including a link having an extension extending beyond said member in the direction away from said pickup unit and carrying cam means engaging cooperating cam means carried by said first plate, the relationship of said member, said linkage and said two cam means forming means for radially projecting and retracting said pickup head in response to pivoting of said member relative to said second plate, and cooperating means carried by said first plate and said shaft for pivoting said member as said plates rotate relative to said fixed shaft.

9. A transfer mechanism according to claim 8 wherein said first and second plates are directly fixedly connected to one another.

10. A transfer mechanism according to claim 8 wherein said first and second plates are directly fixedly connected to one another.

11. A transfer mechanism according to claim 8 wherein said linkage means includes a second link extending between and pivotally connected to said member and said carrier, said second link in conjunction with the first mentioned link forming parallel linkage.

12. A transfer mechanism according to claim 8 wherein said cooperating means includes an eccentric connected to said member.

13. A transfer mechanism according to claim 8 wherein said cooperating means includes a fixed drive element carried by said shaft, a driven element carried by said first plate 1 and rotatable relative to said first plate coupled to said drive element for rotation in response to rotation of said first plate.

14. A transfer mechanism according to claim 13 wherein said cooperating means includes an eccentric connected between said driven element and said member for effecting pivoting of said member.

15. A transfer mechanism according to claim 14 wherein said eccentric is in the form of a pin projecting axially from said driven element and engaged in a radially extending slot in said member.

* * * * *